US010932536B2

(12) United States Patent
Kong

(10) Patent No.: US 10,932,536 B2
(45) Date of Patent: Mar. 2, 2021

(54) CANTILEVER UMBRELLA

(71) Applicant: ZHEJIANG DINGSHENG OUTDOOR LIVING PRODUCTS CO., LTD., Zhejiang (CN)

(72) Inventor: Chengxi Kong, Zhejiang (CN)

(73) Assignee: ZHEJIANG DINGSHENG OUTDOOR LIVING PRODUCTS CO., LTD., Zhejiang (CN)

( * ) Notice: Subject to any disclaimer, the term of this patent is extended or adjusted under 35 U.S.C. 154(b) by 0 days.

(21) Appl. No.: 16/547,600

(22) Filed: Aug. 22, 2019

(65) Prior Publication Data

US 2020/0063462 A1 Feb. 27, 2020

(30) Foreign Application Priority Data

Aug. 22, 2018 (CN) ..... 201810960961.5

(51) Int. Cl.
*A45B 17/00* (2006.01)
*A45B 23/00* (2006.01)
(Continued)

(52) U.S. Cl.
CPC ..... *A45B 23/00* (2013.01); *A45B 17/00* (2013.01); *A45B 25/02* (2013.01);
(Continued)

(58) Field of Classification Search
CPC ..... A45B 17/00; A45B 23/00; A45B 25/14; A45B 19/10; A45B 2023/0037;
(Continued)

(56) References Cited

U.S. PATENT DOCUMENTS 2,819,725 A * 1/1958 Deisenroth ..... A45B 17/00 135/20.3
5,169,111 A * 12/1992 Dunaj ..... A45B 25/24 248/523

(Continued)

FOREIGN PATENT DOCUMENTS

CN 203538551 4/2014
CN 106388174 A * 2/2017 ..... A45B 23/00
CN 108771311 11/2018

OTHER PUBLICATIONS 11 page PDF,machine translation CN 06388174-A. (Year: 2017).*

*Primary Examiner* — Robert Canfield
(74) *Attorney, Agent, or Firm* — JCIP Global Inc.

(57) ABSTRACT

A cantilever umbrella including a frame having an upper tray and a lower tray is provided. Two first crossed rods, a transverse rod and a first long rib are articulated to the upper tray. Two second crossed rods and two first short ribs are articulated to the lower tray. One of the two first short ribs is articulated to a middle portion of the transverse rod and the other one is articulated to a middle portion of the first long rib. A middle portion of each second crossed rod is articulated to a middle portion of the first crossed rod on a same side. An end of each first crossed rod is articulated with a short-rib tray which is articulated to a short rib, and an end of each second crossed rod is articulated with a long-rib tray which is articulated to a long rib. The short ribs each has one end articulated to the short-rib tray and another end articulated to a middle portion of one of the long ribs. The upper tray and the two long-rib trays are each disposed with a cap thereon, and a canopy fabric is covered on the long ribs to form three canopies.

16 Claims, 8 Drawing Sheets

(51) Int. Cl.
*A45B 25/02* (2006.01)
*A45B 11/00* (2006.01)

(52) U.S. Cl.
CPC ... *A45B 2011/005* (2013.01); *A45B 2023/005* (2013.01); *A45B 2023/0012* (2013.01); *A45B 2023/0037* (2013.01); *A45B 2023/0056* (2013.01)

(58) Field of Classification Search
CPC .... A45B 2023/0012; A45B 2023/0075; A45B 2023/005; A45B 2023/0031; A45B 2023/0056; A45B 2011/005; E04H 15/28; E04H 15/04; E04H 15/50; A01M 31/025
USPC ..... 135/90, 98, 20.1, 20.3, 21, 25.2, 25.24, 135/28–29, 31–32, 97
See application file for complete search history.

(56) References Cited

U.S. PATENT DOCUMENTS 5,263,505 A * 11/1993 Yeom ..... A45B 11/00 135/20.1
5,927,310 A * 7/1999 Lin ..... A45B 23/00 135/20.1
5,937,882 A * 8/1999 Harbaugh ..... A45B 23/00 135/20.3
5,960,806 A * 10/1999 Steiner ..... A45B 23/00 135/20.1
6,113,054 A * 9/2000 Ma ..... E04H 12/2238 248/158
6,196,242 B1 * 3/2001 Xu ..... A45B 23/00 135/20.1
6,230,727 B1 * 5/2001 Chen ..... E04H 15/28 135/127
6,354,315 B1 * 3/2002 Liu ..... A45B 19/12 135/28
6,401,735 B1 * 6/2002 Chou ..... A45B 23/00 135/20.1
6,694,993 B2 * 2/2004 Chou ..... A45B 23/00 135/98
6,923,194 B2 * 8/2005 Li ..... A45B 3/00 135/16
7,431,259 B2 * 10/2008 Tung ..... A45B 17/00 135/20.3
8,104,492 B2 * 1/2012 Dan ..... A45B 23/00 135/20.3
8,511,327 B2 * 8/2013 Sun ..... A45B 19/12 135/20.1
9,167,873 B2 * 10/2015 May ..... A45B 23/00
9,220,325 B2 * 12/2015 Ma ..... A45B 23/00
9,289,038 B2 * 3/2016 Ma ..... A45B 25/08
10,136,709 B2 * 11/2018 Ma ..... A45B 23/00
10,426,236 B1 * 10/2019 Huckvale ..... A45B 25/26
10,455,912 B2 * 10/2019 Arndt ..... A45B 25/10
10,537,161 B1 * 1/2020 Volin ..... A45B 25/02
D885,744 S * 6/2020 Xu ..... D3/5
2002/0139405 A1 * 10/2002 Lee ..... A45B 25/02 135/28
2004/0163691 A1 * 8/2004 Ma ..... A45B 19/12 135/25.2
2005/0016571 A1 * 1/2005 Wu ..... A45B 23/00 135/20.1
2015/0284973 A1 * 10/2015 Arndt ..... E04H 15/28 135/98
2016/0113364 A1 * 4/2016 Ostrander ..... A45B 23/00 135/20.1
2018/0352921 A1 * 12/2018 Arndt ..... A45B 23/00

* cited by examiner

CANTILEVER UMBRELLA

CROSS-REFERENCE TO RELATED APPLICATION

This application claims benefit to Chinese Patent Application for a volute for a cantilever umbrella, 201810960961.5, filed on Aug. 22, 2018. The specification of the application is incorporated here by this reference.

TECHNICAL FIELD OF THE INVENTION

The present invention relates to the technical field of outdoor umbrellas and in particular to a cantilever umbrella.

BACKGROUND OF THE INVENTION

Umbrellas, belonging to leisure items, are mainly used in squares, beaches, parks, gardens or similar places, to shield an individual from sun or rain. Generally, umbrellas include center-support umbrellas and side-support umbrellas. The side support umbrellas include upright-pole cantilever umbrellas which are popular with people due to their convenience in usage, storage and transportation. The demands for such upright-pole cantilever umbrellas are increasing. With the improvement of living standards, cantilever umbrellas with high portability and large unfolded area become the development trend of future cantilever umbrellas.

To satisfy the above two requirements, a large number of cantilever umbrellas have been designed, which are suitable for various beaches, gardens, parks, lawns in families and hotels, as well as all field trips and outdoor businesses. For example, Chinese Patent 201320541314.3 discloses a umbrella with leftwards and rightwards adjustable sun-shading angle, comprising a base, a stand, a transverse rod, a drawing rod and a frame, wherein the lower end of the transverse rod is arranged on the stand column while the upper end of the transverse rod is connected to the top of the frame; the rear end of the drawing rod is mounted on the top of the stand while the front end of the drawing rod is connected to the middle portion of the transverse rod; and the stand is inserted in the base. Like most cantilever umbrellas, this umbrella has only one canopy. The only way of increasing the unfolded area is to lengthen ribs. If so, the stress of the canopy fabric borne by the ribs is increased, resulting in instability, easy bending or breakage of the ribs. In a large applicable place, it is difficult to offer a large shaded area by a limited cantilever umbrella. If it is to increase the shaded area, multiple umbrellas are needed and this certainly increases the cost. Additionally, such an umbrella is outdated in style and less novel.

SUMMARY OF THE INVENTION

A technical problem to be solved in the present invention is to provide, in view of the state in the prior art, a cantilever umbrella with novel structure, large shading area and high stability.

To solve the technical problem, the cantilever umbrella including a base, a stand inserted on the base, a transverse rod with an upper end, a lower end and a middle portion, a drawing rod with a front end and a rear end, a frame having an upper tray and a lower tray, which are connected by a hanger rod with a left side, a right side, a front side and a rear side, and a canopy fabric is provided. The lower end of the transverse rod is disposed on the stand and the upper end of the transverse rod is articulated to a top of the frame. The rear end of the drawing rod is installed on a top of the stand and the front end of the drawing rod is articulated to the middle portion of the transverse rod. Two first crossed rods, the transverse rod and a first long rib are articulated to the upper tray. Two second crossed rods and two first short ribs are articulated to the lower tray. The two first crossed rods are disposed on the left and right sides of the hanger rod respectively, and the first long rib and the transverse rod are disposed on the front and rear sides of the hanger rod respectively. One of the two first short ribs is articulated to the middle portion of the transverse rod and the other one is articulated to a middle portion of the first long rib. The two second crossed rods are disposed on the left and right sides of the hanger rod respectively and a middle portion of each of the two second crossed rods is articulated to a middle portion of one of the two first crossed rods on a same side. A lower end of each of the first crossed rods is articulated to a short-rib tray and an upper end of each of the second crossed rods is articulated to a long-rib tray, wherein a plurality of long ribs is articulated to the long-rib tray, a plurality of short ribs is articulated to the short-rib tray, the number of the long ribs is the same as the number of the short ribs, and each short rib has one end articulated to the short-rib tray and another end articulated to a middle portion of one of the long ribs. The upper tray and the two long-rib trays are each disposed with a cap thereon. The canopy fabric is covered on the long ribs to form three canopies.

Preferably, a sliding sleeve, which is movable up and down to adjust the frame, is disposed on the stand. The transverse rod is a hollow transverse rod, the lower end of which is articulated to the sliding sleeve and the upper end of which is articulated to the upper tray. Two ends of the transverse rod are each configured with a first rope pulley inside a cavity of the transverse rod. The middle portion of the transverse rod has, at a lower side, an internal transverse arm hinge which is articulated to the first short rib and, at an upper side, an external transverse arm hinge which is articulated to the drawing rod.

Preferably, a crank control mechanism which can control the opening/closing of the frame and a locking mechanism are configured on the sliding sleeve. The crank control mechanism comprises a crank handle, a rope guard and a rope reel. A second rope pulley is disposed inside the hanger rod. One end of a rope is fixed on the rope reel and the other end of the rope is passed through the cavity of the transverse rod and a cavity of the hanger rod to be connected to the lower tray. The locking mechanism comprises a locking trigger having a head portion rotatably connected in the sliding sleeve. The locking trigger is constantly kept to be pressed inward, by using a torsional spring. A locking block, which is fitted with the locking trigger, is also disposed inside the sliding sleeve. When the locking trigger is triggered to be in a locked state, a top end of the locking trigger pushes the locking block to be in a frictional contact with the stand.

Preferably, a first rib slot, which is articulated to the upper end of the transverse rod, is disposed at an upper end of the upper tray, and a rope hole, through which the rope passes, is formed at a center position of a bottom side of the first rib slot. A second rib slot, which is articulated to the first long rib, is formed on a face, opposite to the first rib slot, of the upper end of the upper tray. Two third rib slots, which are respectively articulated to an end of one of the first crossed rods, are formed at a lower end of the upper tray. The two third rib slots are rotationally symmetric.

Preferably, four rib slots are formed on the lower tray. Two of the four rib slots are fourth rib slots which are symmetric and to which the first short ribs are articulated, and the other two of the four rib slots are fifth rib slots which are rotationally symmetric and to which the second crossed rods are articulated.

Preferably, one of the long-rib trays and one of the short-rib trays on a same side are located in a same perpendicular line, and are connected by one of the first crossed rods and one of the second crossed rods on the same side, respectively. The long-rib trays, the short-rib trays, the first crossed rods, the second crossed rods, the short ribs and the long ribs that are respectively located on the left and right sides of the hanger rod form two groups of frame structures, which are symmetric leftward and rightward, by considering the hanger rod as a center.

Preferably, each of the long-rib trays is asymmetric and is formed with a sixth rib slot at the lower end thereof, and the sixth rib slot is articulated to the upper end of the corresponding second crossed rod, wherein one side of the sixth rib slot is close to a midline of the each of the long-rib trays and another side is away from the midline of the each of the long-rib trays. Each of the short-rib trays has a same structure as the long-rib trays and is formed with a seventh rib slot at an upper end thereof, and the seventh rib slot is articulated to the lower end of the corresponding first crossed rod, wherein one side of the seventh rib slot is close to a midline of the each of the short-rib trays and another side is away from the midline of the each of the short-rib trays.

Preferably, five long ribs are articulated to each of the long-rib trays, and correspondingly, five short ribs are articulated to each of the short-rib trays. Five eighth rib slots are distributed on each of the long-rib trays and are each articulated to an end of one of the five long ribs, and a steel ring is disposed in the each of the long-rib trays and passes through holes formed at the ends of the five long ribs to articulate the five long ribs to the each of the long-rib trays. Five ninth rib slots are distributed on each of the short-rib trays and are each articulated to an end of one of the five short ribs, and a steel ring is disposed in the each of the short-rib trays and passes through holes formed at the ends of the five short ribs to articulate the five short ribs to the each of the short-rib trays.

Preferably, an upright tube is disposed on the base, a screw hole is formed on the upright tube in a radial direction, a corresponding threaded hole is formed at a lower end of the stand, and the stand is inserted in the upright tube and fixed by hand-operated screws.

Finally, a stand hinge, which is movably connected to the drawing rod, is disposed on a top end of the stand, and a limiting pin, which is used for limiting an upward movement position of the sliding sleeve, is disposed in an upper portion of the stand.

Compared with the conventional art, the present invention has the following advantages: in addition to the upper tray and the lower tray, two pairs of long-rib trays and short-rib trays are further configured, and the two long-rib trays and the upper tray form the three canopies so that the unfolded area is greatly increased. Moreover, by the coordination of the first crossed rods and the second crossed rods, the two pairs of long-rib trays and short-rib trays get close to or away from the stand, in order to fold or unfold the canopy fabric. The cantilever umbrella of the present invention is novel in structure such that it has a large unfolded area which effectively increases the sun-shading area, and also has rational structure and high stability. Meanwhile, the cantilever umbrella of the present invention is convenient to operate and an opening angle of the umbrella can be adjusted arbitrarily; and it is small in volume when being folded, and also highly practical to satisfy the sub-shading demand in a large place.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

In the following detailed description of the preferred embodiments, reference is made to the accompanying drawings which form a part hereof, and in which are shown by way of illustration specific embodiments in which the invention may be practiced.

Figure 1:
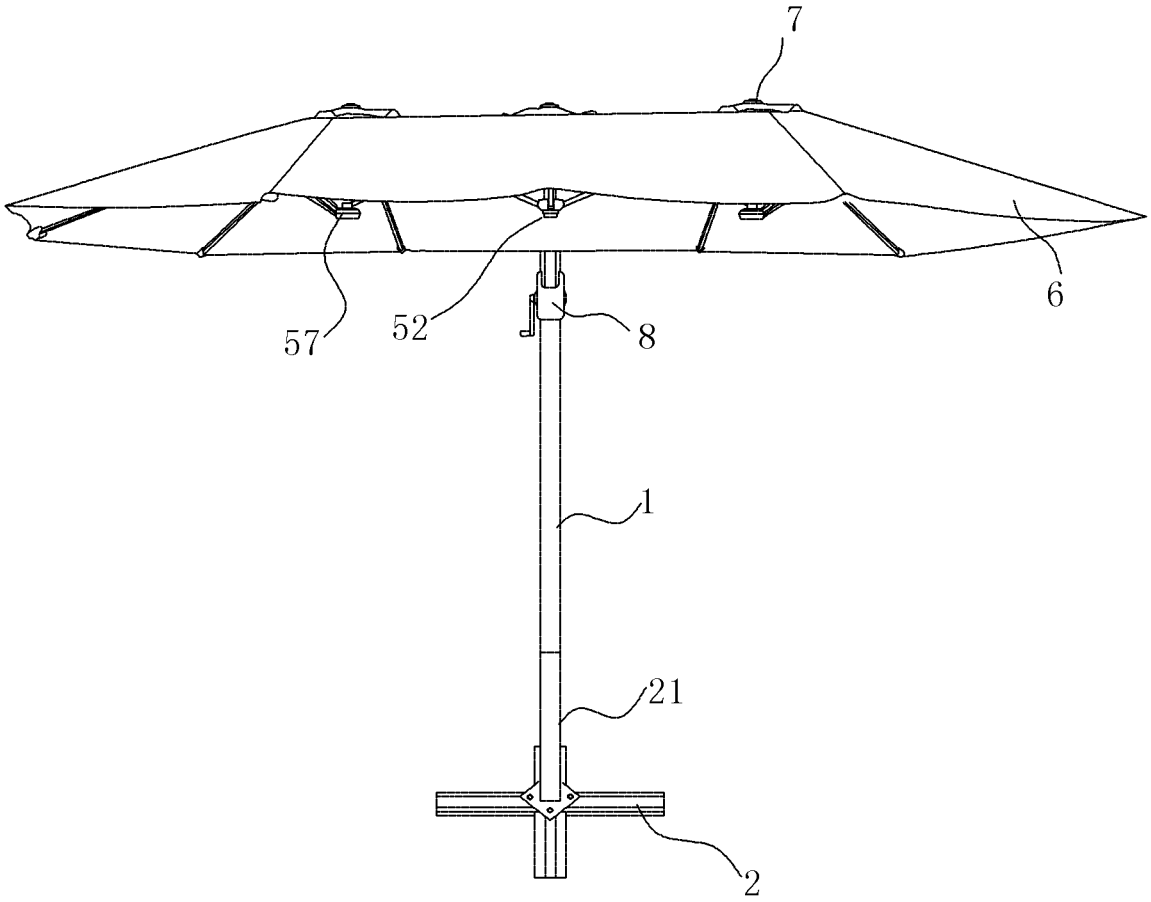
FIG. 1 is a perspective view of a cantilever umbrella according to an embodiment of the present invention.
Figure 2:
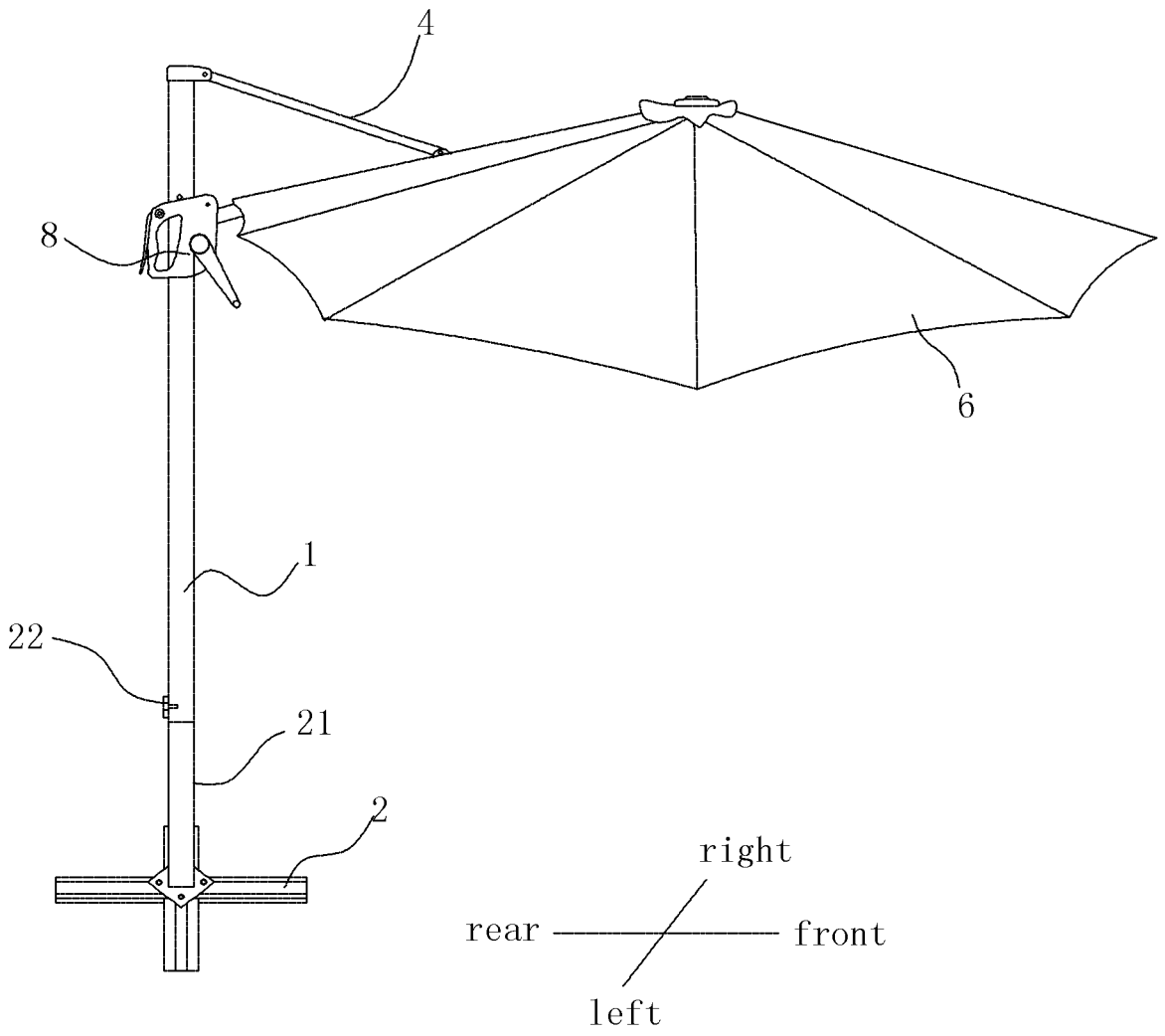
FIG. 2 is a side view of FIG. 1.
Figure 3:
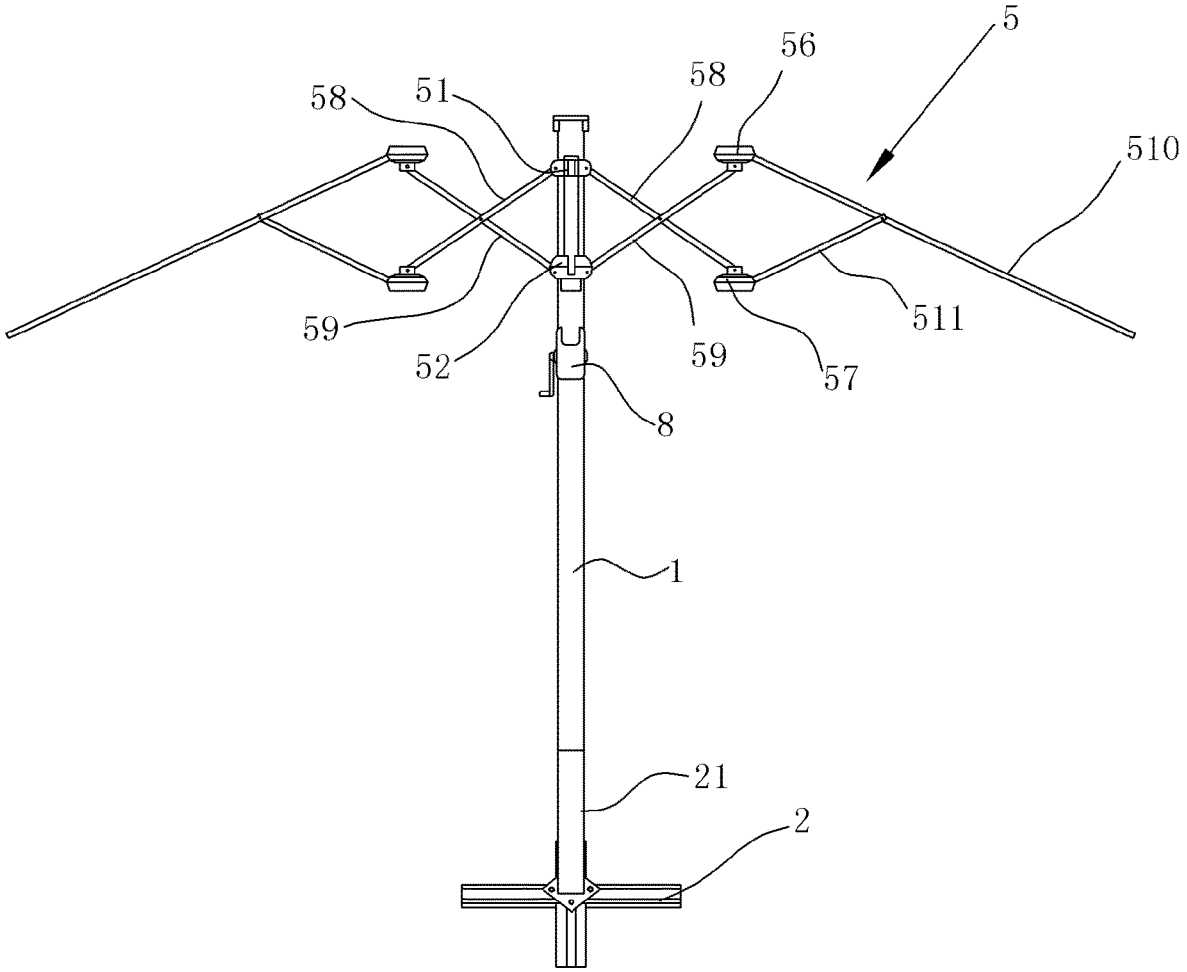
FIG. 3 is a perspective view of FIG. 1, after removal of canopy fabric.
Figure 4:
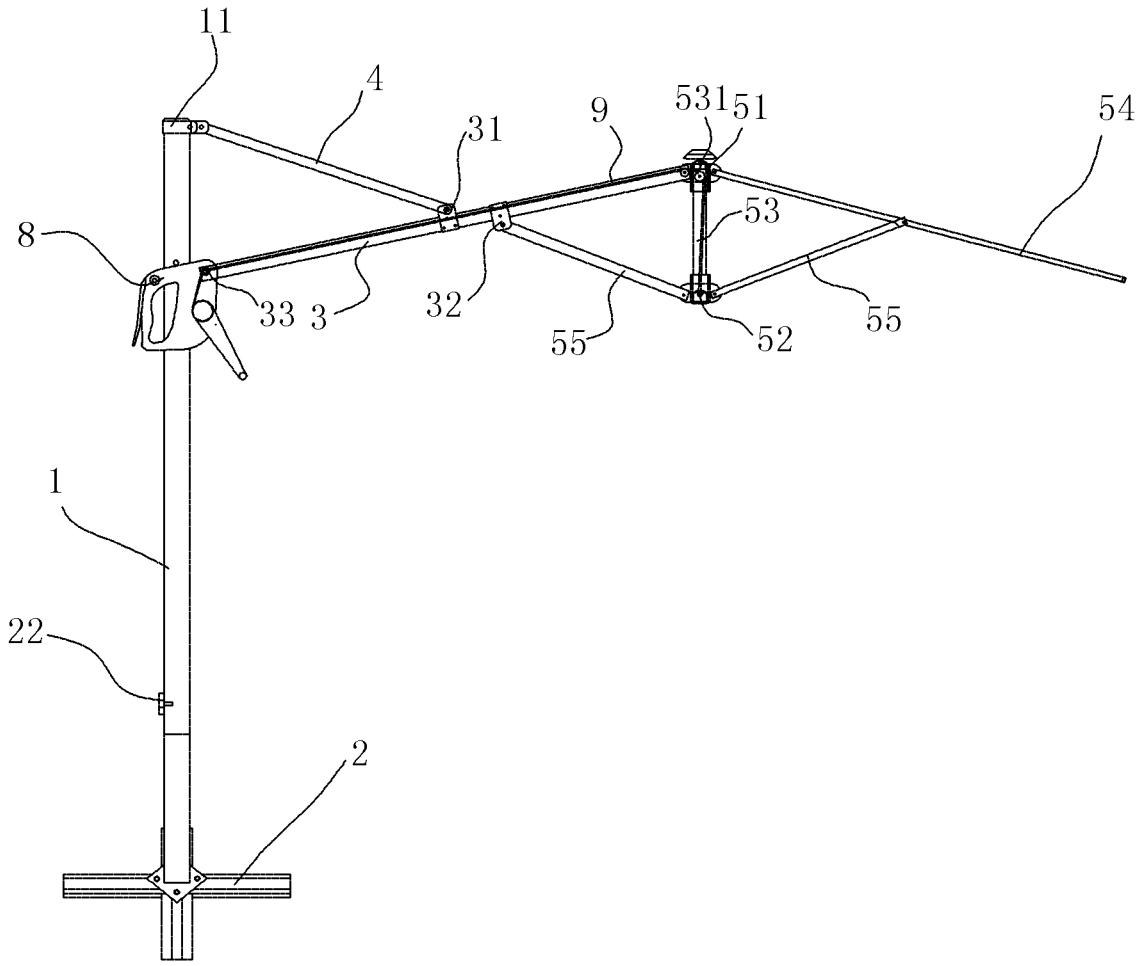
FIG. 4 is a perspective view of FIG. 2, after removal of canopy fabric.

As shown in FIG. 1 to FIG. 13, a cantilever umbrella including a base 2, a stand 1 disposed on the base 2, a transverse rod 3 with an upper end, a lower end and a middle portion, a drawing rod 4 with a front end and a rear end, a frame 5 having an upper tray 51 and a lower tray 52, which are connected by a hanger rod 53 with a left side, a right side, a front side and a rear side, and a canopy fabric 6 is provided. An upright tube 21 is disposed on the base 2, a screw hole is formed on the upright tube 21 in a radial direction, a corresponding threaded hole is formed at a lower end of the stand 1, and the stand 1 is inserted in the upright tube 2 and fixed by hand-operated screws 22. The lower end of the transverse rod 3 is disposed on the stand 1 and the upper end of the transverse rod 3 is articulated to the top of the frame 5. In a front-rear direction, the rear end of the drawing rod 4 is movably installed on the top of the stand 1 and the front end of the drawing rod 4 is articulated to the middle portion of the transverse rod 3, as shown in FIG. 2 and FIG. 4. In a left-right direction, two first crossed rods 58 are articulated to the upper tray 51, as shown in FIG. 3. In a front-rear direction, a first long rib 54 and the transverse rod 3 are articulated to the upper tray 51, as shown in FIG. 4. Correspondingly, in the left-right direction, two second crossed rods 59 are articulated to the lower tray 52. In the front-rear direction, two first short ribs 55 are articulated to the lower tray 52. Referring to FIG. 3, the two first crossed rods 58 are disposed on the left and right sides of the hanger rod 53 respectively, the first long rib 54 and the transverse rod 3 are disposed on the front and rear sides of the hanger rod 53 respectively, and one of the two first short ribs 55 is articulated to the middle portion of the transverse rod 3 and the other one is articulated to a middle portion of the first long rib 54. The two second crossed rods 59 are disposed on the left and right sides of the hanger rod 53, and a middle portion of each of the two second crossed rods 59 is articulated to a middle portion of one of the first crossed rods 58 on a same side. A lower end of each of the two first crossed rods 58 is articulated to a short-rib tray 57, and an upper end of each of the two second crossed rods 59 is articulated to a long-rib tray 56, wherein five long ribs 510 are articulated to the long-rib tray 56; and correspondingly, five short ribs 511 are articulated to the short-rib tray 57. Each short rib 511 has one end articulated to the short-rib tray 57 and another end articulated to a middle portion of one of the long ribs 510. The upper tray 51 and the two long-rib trays 56 are each disposed with a cap 7 thereon, and the canopy fabric 6 is covered on the long ribs 510 to form three canopies each being covered by the cap 7.

Figure 11:
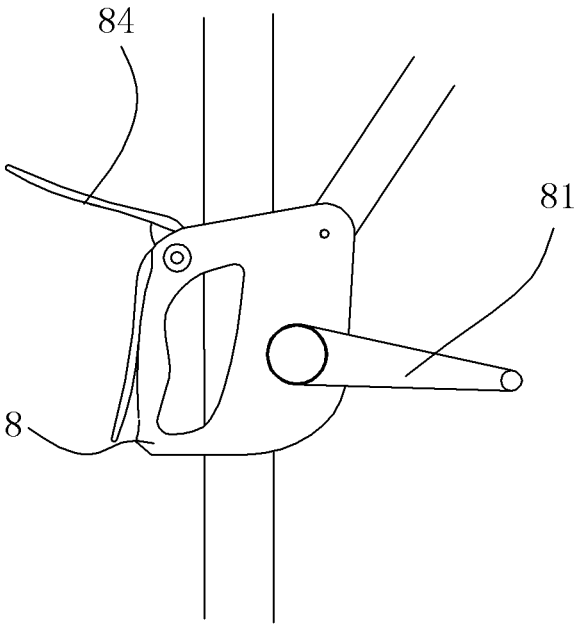
FIG. 11 is a perspective view of a sliding sleeve of the cantilever umbrella according to the embodiment of the present invention.
Figure 12:
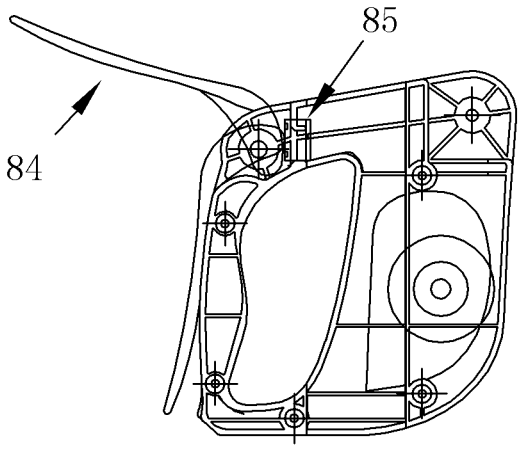
FIG. 12 is a sectional view of the sliding sleeve.
Figure 13:
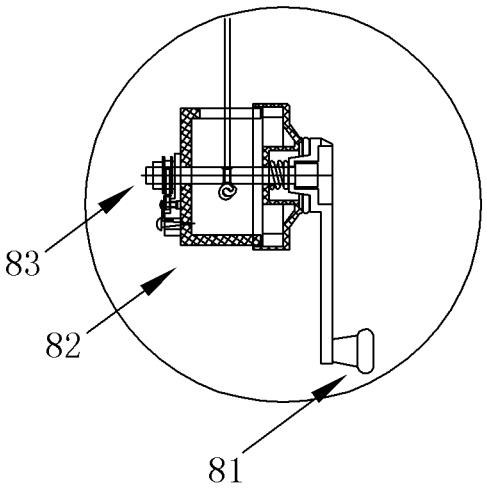
FIG. 13 is a perspective view of a crank control mechanism of the sliding sleeve.

As shown in FIG. 1 to FIG. 4, a sliding sleeve 8, which is movable up and down to adjust the frame 5, is disposed on the stand 1. The transverse rod 3 is a hollow transverse rod, the lower end of which is articulated to the sliding sleeve 8 and the upper end of which is articulated to the upper tray 51. The two ends of the transverse rod 3 are each configured with a rope pulley 33 inside a cavity of the transverse rod 3. The middle portion of the transverse rod 3 has, at a lower side, an internal transverse arm hinge 32 which is articulated to the first short rib 55 and, at an upper side, an external transverse arm hinge 31 which is articulated to the drawing rod 4. Referring to FIG. 11 through FIG. 13, a crank control mechanism, which can control the frame 5 to open up or close down, and a locking mechanism are configured on the sliding sleeve 8. The crank control mechanism includes a crank handle 81, a rope guard 82 and a rope reel 83. A rope pulley 531 as shown in FIG. 4 is disposed inside the hanger rod 53, wherein one end of a rope 9 is fixed on the rope reel 83 and the other end of the rope 9 is passed through the cavity of the transverse rod 3 and the cavity of the hanger rod 53 to be connected to the lower tray 52. The locking mechanism includes a locking trigger 84 having a head portion rotatably connected in the sliding sleeve 8. Usually, the locking trigger 84 is always and constantly kept to be pressed inward, by using a torsional spring. A locking block 85, which is fitted with the locking trigger 84, is also disposed inside the sliding sleeve 8. When the locking trigger 84 is triggered to be in the locked state, a top end of the locking trigger 84 pushes the locking block 85 to be in a frictional contact with the stand 1.

The specific structure will be described below.

Figure 7:
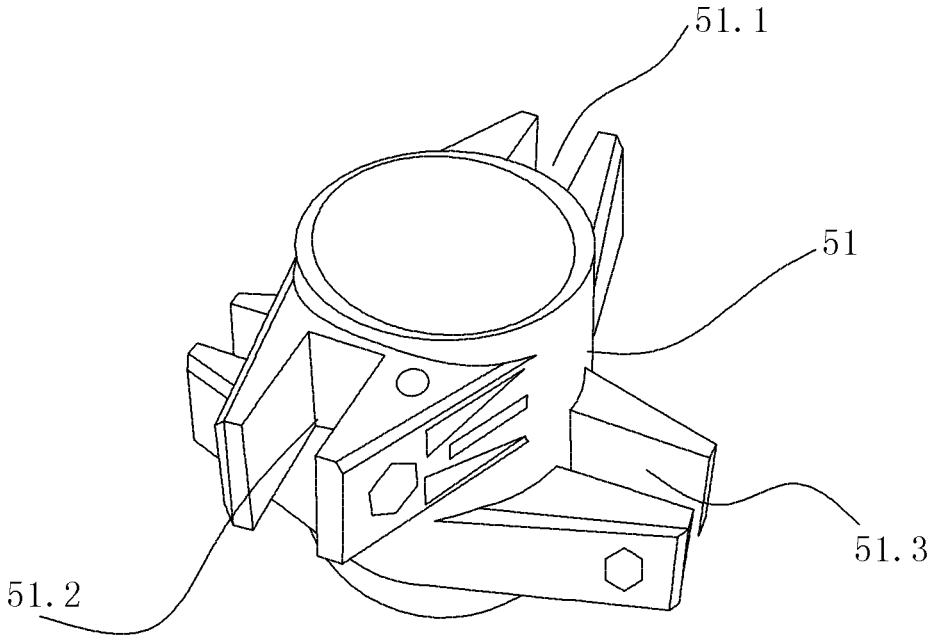
FIG. 7 is a perspective view of an upper tray of the cantilever umbrella according to the embodiment of the present invention.
Figure 8:
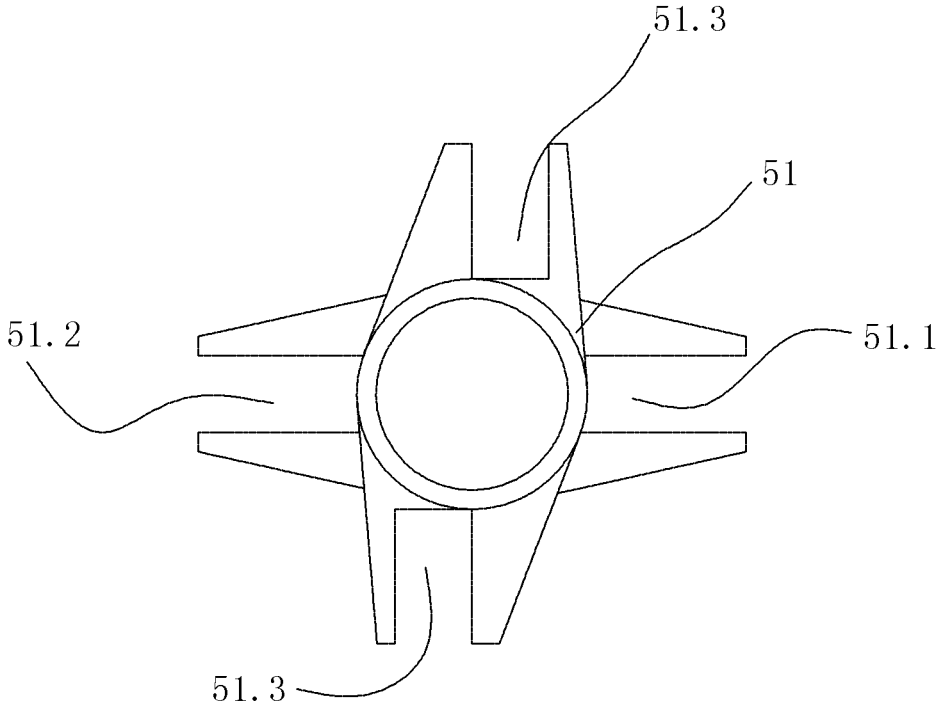
FIG. 8 is a top view of FIG. 7.
Figure 9:
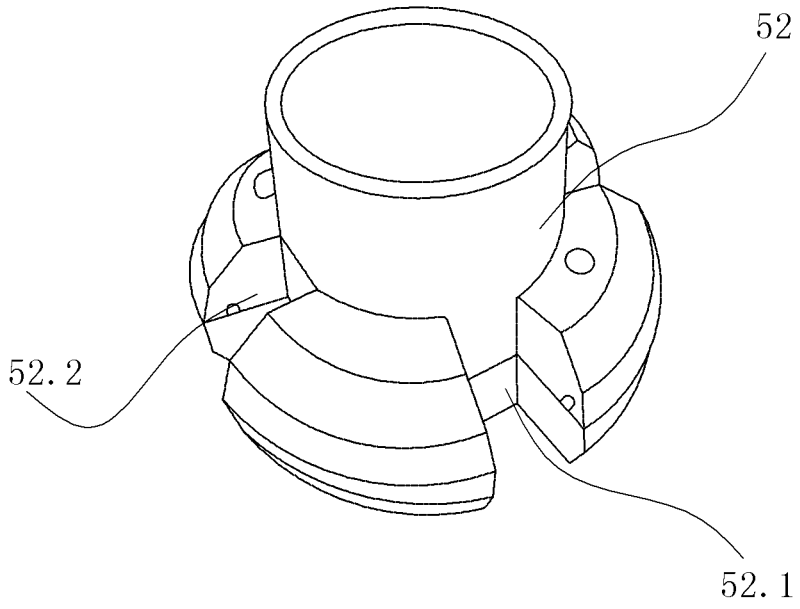
FIG. 9 is a perspective view of a lower tray of the cantilever umbrella according to the embodiment of the present invention.
Figure 10:
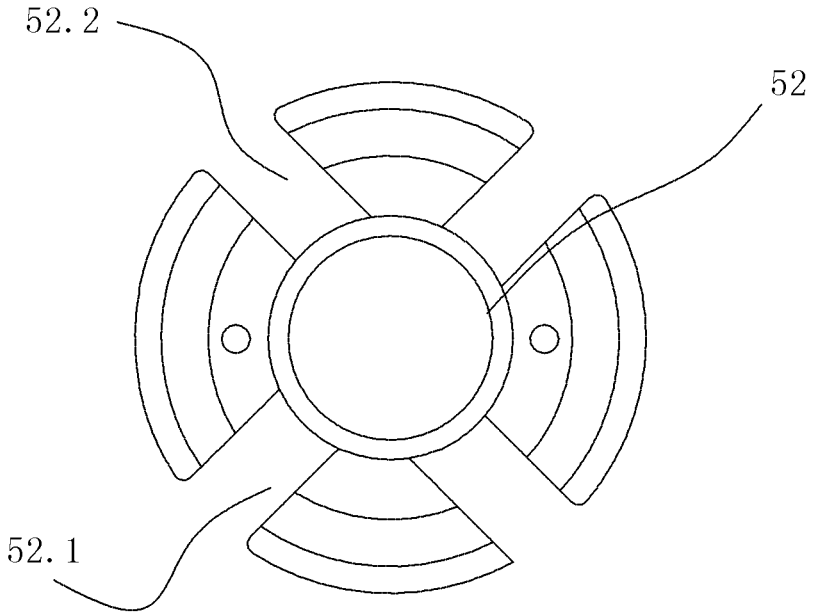
FIG. 10 is a top view of FIG. 9.

Referring to FIG. 3, FIG. 7 and FIG. 8 at the same time, a first rib slot 51.1, which is articulated to the upper end of the transverse rod 3, is disposed at the upper end of the upper tray 51, and a rope hole, through which the rope 9 passes, is formed at a center position of a bottom side of the first rib slot 51.1. A second rib slot 51.2, which is articulated to the first long rib 54, is formed on a face, opposite to the first rib slot 51.1, of the upper end of the upper tray 51. Two third rib slots 51.3, which are respectively articulated to an end of one of the first crossed rods 58, are formed at the lower end of the upper tray 51. The two third rib slots 51.3 are rotationally symmetric. Four rib slots are formed on the lower tray 52. The front and rear two of the four rib slots are fourth rib slots 52.1 which are symmetric and to which the first short ribs 55 are articulated, and the left and right two are fifth rib slots 52.2 which are rotationally symmetric and to which the second crossed rods 59 are articulated. One of the long-rib trays 56 and one of the short-rib trays 57 on a same side are located in a same perpendicular line, and are articulated to one of the second crossed rods 59 and one of the first crossed rods 58, respectively.

To keep the two long-rib trays 56 balanced in relative to the hanger rod 53, the two second crossed rods 59 are eccentrically mounted on the long-rib trays 56, and the two first crossed rods 58 are eccentrically articulated to the short-rib trays 57. In this way, the upper tray 51 and the two long-rib trays 56 are positioned on a same line. The long-rib trays 56, the short-rib trays 57, the first crossed rods 58, the second crossed rods 59, the short ribs 511 and the long ribs 510 that are respectively located on the left and right sides of the hanger rod 53 form two groups of frame structures, which are symmetric leftward and rightward, by considering the hanger rod 53 as a center.

Figure 5:
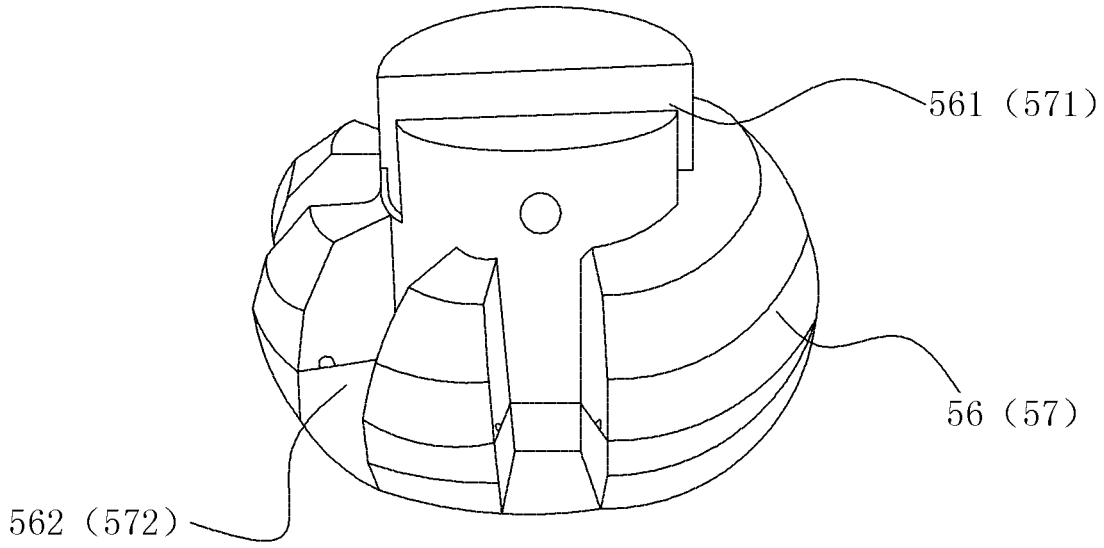
FIG. 5 is a perspective view of a long-rib tray or a short-rib tray according to the present invention.
Figure 6:
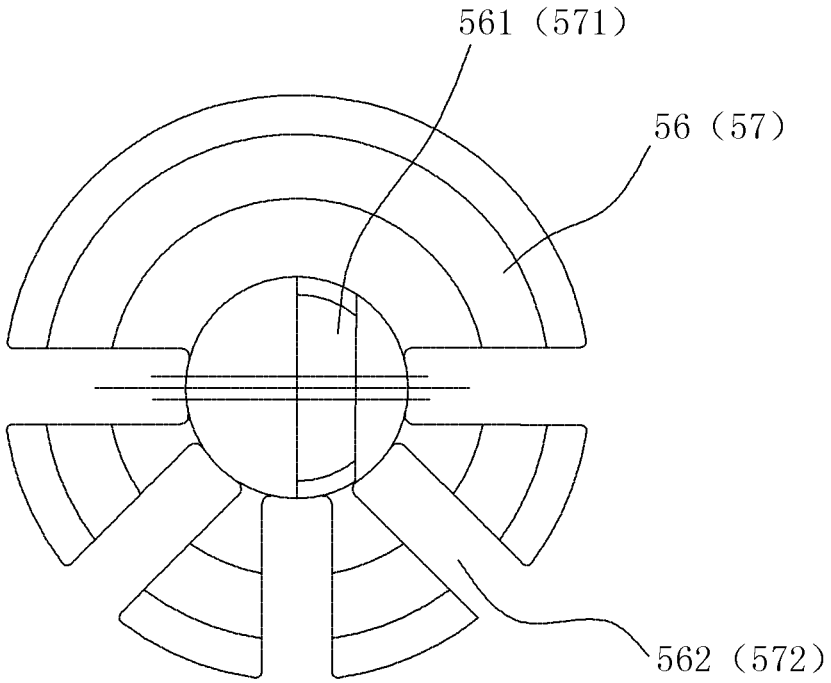
FIG. 6 is a top view of FIG. 5.

Referring to FIG. 5 and FIG. 6, the long-rib tray 56 is asymmetric, a sixth rib slot 561, to which the upper end of the corresponding second crossed rod 59 is articulated, is formed at a lower end of the long-rib tray 56, and one side of the sixth rib slot 561 is close to a midline of the long-rib slot 56 and another side of the sixth rib slot 561 is away from the midline of the long-rib slot 56. The short-rib tray 57 has a same structure as the long-rib tray 56, wherein a seventh rib slot 571, to which the lower end of the corresponding first crossed rod 58 is articulated, is formed at an upper end of the short-rib tray 57, and one side of the seventh rib slot 571 is close to a midline of the short-rib slot 57 and another side of the seventh rib slot 571 is away from the midline of the short-rib slot 57. Five eighth rib slots 562, to which the ends of the long ribs 510 are respectively articulated, are evenly distributed on a big half of the upper end of the long-rib tray 56, and a steel ring is disposed in the long-rib tray 56 and passes through holes formed at the ends of the five long ribs 510 to articulate the five long ribs 510 to the long-rib tray 56. Five ninth rib slots 572, to which the ends of the short ribs 511 are respectively articulated, are evenly distributed on a big half of the lower end of the short-rib tray 57, to which the ends of the short ribs are articulated, are distributed on the short-rib tray, and a steel ring is provided in the short-rib tray 57 and passes through holes formed at the ends of the five short ribs 511 to articulate the five short ribs 511 to the short-rib tray 57. In this embodiment, to be ease of plotting, the long-rib trays 56 or the short-rib trays 57 are illustrated with a same drawing.

Additionally, as shown in FIG. 4, a stand hinge 11, which is movably connected to the drawing rod 4, is disposed on a top end of the stand 1, and a limiting pin, which is used for limiting an upward movement position of the sliding sleeve 8, is disposed in an upper portion of the stand 1.

When in use, an opening angle of the umbrella can be adjusted arbitrarily by moving, upward or downward, the sliding sleeve 8 on the stand 1, and the locking trigger is locked when a desired angle is achieved. One end of the rope 9 is fixed on the rope reel of the crank control mechanism and the other end thereof passes through the transverse rod 3 and the hanger rod 53 so as to be fixed on a rope stopper in the lower tray 52, as shown in FIG. 4. The rope pulleys 33 and 531 are configured in two ends of the cavity of the transverse rod 3 and in the hanger rod 53 which are required to be turned. This is convenient for the rope 9 to pass through the rope pulleys 33 and 531, thereby making the operation easier. During the operation, the frame 5 can be easily unfolded or folded simply by winding the rope 9 via turning the crank handle clockwisely or counterclockwisely.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A cantilever umbrella, comprising:

a base;

a stand inserted on the base;

a transverse rod with an upper end, a lower end and a middle portion;

a drawing rod with a front end and a rear end;

a frame having an upper tray and a lower tray, which are connected by a hanger rod with a left side, a right side, a front side and a rear side; and, a canopy fabric;

wherein the lower end of the transverse rod is disposed on the stand and the upper end of the transverse rod is articulated to a top of the frame;

the rear end of the drawing rod is installed on a top of the stand and the front end of the drawing rod is articulated to the middle portion of the transverse rod;

two first crossed rods, the transverse rod and a first long rib are articulated to the upper tray;

two second crossed rods and two first short ribs are articulated to the lower tray;

the two first crossed rods are disposed on the left and right sides of the hanger rod respectively, and the first long rib and the transverse rod are disposed on front and rear sides of the hanger rod respectively;

one of the two first short ribs is articulated to the middle portion of the transverse rod and the other one is articulated to a middle portion of the first long rib;

the two second crossed rods are disposed on the left and right sides of the hanger rod respectively, and a middle portion of each of the two second crossed rods is articulated to a middle portion of one of the two first crossed rods on a same side;

a lower end of each of the two the first crossed rods is articulated to a short-rib tray, and an upper end of each of the two second crossed rods is articulated to a long-rib tray, wherein a plurality of long ribs is articulated to the long-rib tray, a plurality of short ribs is articulated to the short-rib tray, the number of the long ribs is the same as the number of the short ribs, and each short rib has one end articulated to the short-rib tray and another end articulated to a middle portion of one of the long ribs;

the upper tray, the lower tray, the hanger rod, the first long rib, the long-rib tray, and the short-rib tray are all suspended through the transverse rod;

the upper tray and the two long-rib trays are each disposed with a cap thereon;

the canopy fabric is covered on the long ribs to form a canopy with three caps horizontally located at a same height;

a first rib slot, which is articulated to the upper end of the transverse rod, is disposed at an upper end of the upper tray;

a second rib slot, which is articulated to the first long rib, is formed on a face, opposite to the first rib slot, of the upper end of the upper tray;

two third rib slots, which are respectively articulated to an end of one of the first crossed rods, are formed at a lower end of the upper tray; and the two third rib slots are rotationally symmetric.

2. The cantilever umbrella of claim 1, wherein a sliding sleeve, which is movable up and down to adjust the frame, is disposed on the stand;

the transverse rod is a hollow transverse rod, the lower end of which is articulated to the sliding sleeve and the upper end of which is articulated to the upper tray;

the two ends of the transverse rod are each configured with a first rope pulley inside a cavity of the transverse rod; and the middle portion of the transverse rod has, at a lower side, an internal transverse arm hinge which is articulated to the first short rib and, at an upper side, an external transverse arm hinge which is articulated to the drawing rod.

3. The cantilever umbrella of claim 2, wherein a crank control mechanism, which is able to control the frame to open up or close down, and a locking mechanism are configured on the sliding sleeve;

the crank control mechanism comprises a crank handle, a rope guard and a rope reel;

a second rope pulley is disposed inside the hanger rod;

one end of a rope is fixed on the rope reel and the other end of the rope is passed through the cavity of the transverse rod and a cavity of the hanger rod to be connected to the lower tray;

the locking mechanism comprises a locking trigger having a head portion rotatably connected in the sliding sleeve;

the locking trigger is constantly kept to be pressed inward, by using a torsional spring;

a locking block, which is fitted with the locking trigger, is also disposed inside the sliding sleeve; and when the locking trigger is triggered to be in a locked state, a top end of the locking trigger pushes the locking block to be in a frictional contact with the stand.

4. The cantilever umbrella of claim 1, wherein four rib slots are formed on the lower tray, two of the four rib slots are fourth rib slots which are symmetric and to which the first short ribs are articulated, and the other two of the four rib slots are fifth rib slots which are rotationally symmetric and to which the second crossed rods are articulated.

5. The cantilever umbrella of claim 4, wherein one of the long-rib trays and one of the short-rib trays on a same side are located in a same vertical line, and are connected by one of the first crossed rods and one of the second crossed rods on the same side, respectively; and the long-rib trays, the short-rib trays, the first crossed rods, the second crossed rods, the short ribs and the long ribs that are respectively located on the left and right sides of the hanger rod form two groups of frame structures, which are symmetric leftward and rightward, by considering the hanger rod as a center.

6. The cantilever umbrella of claim 4, wherein each of the long-rib tray is asymmetric and is formed with a sixth rib slot at a lower end thereof, and the sixth rib slot is articulated to the upper end of the corresponding second crossed rod, wherein one side of the sixth rib slot is close to a midline of the long-rib tray and another side of the sixth rib slot is away from the midline of the long-rib tray; and each of the short-rib trays has a same structure as the long-rib trays and is formed with a seventh rib slot at an upper end thereof, and the seventh rib slot is articulated to the lower end of the corresponding first crossed rod, wherein one side of the seventh rib slot is close to a midline of the short-rib tray and another side is away from the midline of the short-rib tray.

7. The cantilever umbrella of claim 4, wherein five long ribs are articulated to each of the long-rib trays, and correspondingly, five short ribs are articulated to each of the short-rib trays;

five eighth rib slots are distributed on the each of the long-rib trays, and the five eighth rib slots are each articulated to an end of one of the five long ribs;

five ninth rib slots are distributed on the each of the short-rib trays, and the five ninth rib slots are each articulated to an end of one of the five short ribs; and, a steel ring is disposed in the each of the short-rib trays and passes through holes formed at the ends of the five short ribs to articulate the five short ribs to the each of the short-rib trays.

8. The cantilever umbrella-of claim 1, wherein an upright tube is disposed on the base, and the stand is fixedly inserted in the upright tube.

9. The cantilever umbrella of claim 2, wherein a stand hinge, to which the drawing rod is pivotally connected, is disposed on a top end of the stand, and a limiting pin, which is used for limiting an upward movement position of the sliding sleeve, is disposed in an upper portion of the stand.

10. The cantilever umbrella of claim 2, wherein an upright tube is disposed on the base, and the stand is fixedly inserted in the upright tube.

11. The cantilever umbrella of claim 3, wherein a stand hinge, to which the drawing rod is pivotally connected, is disposed on a top end of the stand, and a limiting pin, which is used for limiting an upward movement position of the sliding sleeve, is disposed in an upper portion of the stand.

12. The cantilever umbrella of claim 3, wherein an upright tube is disposed on the base, and the stand is fixedly inserted in the upright tube and fixed by hand-operated screws.

13. The cantilever umbrella of claim 4, wherein an upright tube is disposed on the base, and the stand is fixedly inserted in the upright tube and fixed by hand-operated screws.

14. The cantilever umbrella of claim 5, wherein an upright tube is disposed on the base, and the stand is fixedly inserted in the upright tube and fixed by hand-operated screws.

15. The cantilever umbrella of claim 6, wherein an upright tube is disposed on the base, and the stand is fixedly inserted in the upright tube and fixed by hand-operated screws.

16. The cantilever umbrella of claim 7, wherein an upright tube is disposed on the base, and the stand is fixedly inserted in the upright tube and fixed by hand-operated screws.

* * * * *